United States Patent [19]

Paulson et al.

[11] Patent Number: 4,760,835

[45] Date of Patent: Aug. 2, 1988

[54] BALL THROWING DEVICE

[76] Inventors: Kerry K. Paulson, 44 SW. Eagle Crest Dr. #18; John G. Paulson, 2896 SW. Lakeview Blvd., both of Lake Oswego, Oreg. 97034; John K. Paulson, deceased, late of Lake Oswego, Oreg., by Kerry K. Paulson, John G. Paulson, executors

[21] Appl. No.: 792,654

[22] Filed: Oct. 29, 1985

[51] Int. Cl.[4] ..... F41B 3/04

[52] U.S. Cl. ..... 124/78; 273/26 D; 124/80

[58] Field of Search ..... 273/26 D, 29 A; 124/78, 124/80, 81, 1, 6

[56] References Cited

U.S. PATENT DOCUMENTS

| | | | |
|---|---|---|---|
| Re. 30,703 | 8/1981 | Paulson et al. | 273/26 D |
| 3,774,584 | 11/1973 | Paulson | 124/78 |
| 3,924,853 | 12/1975 | Schleeger | 273/29 A |
| 4,323,048 | 4/1982 | Saito et al. | 124/78 |
| 4,423,717 | 1/1984 | Kahelin | 273/26 D |
| 4,508,340 | 4/1985 | Liao | 273/29 A |

*Primary Examiner*—Richard C. Pinkham

*Assistant Examiner*—T. Brown

*Attorney, Agent, or Firm*—Olson & Olson

[57] ABSTRACT

A pair of spaced, resiliently tired wheels are mounted on a base for axial rotation in a common plane, the spacing between the wheels being less than the diameter of a ball to be thrown and the rotational speed of each wheel being adjustable independently of the other. The base is supported on a universal mounting ball by means of a socket located on the base at the center of gravity of the assembly of base and components supported thereon. The universal mounting ball is supported at the upper end of an angularly bent support arm, whereby to afford angular adjustment of the rotational plane of the wheels infinitely in all directions about the common pivot of the mounting ball, between horizontal and vertical positions. Electrical controls are provided for controlling the speed of rotation of the coacting wheels. A ball infeed chute is mounted on the base for rotational adjustment about the ball projecting line between the spaced wheels, for maintaining the feed chute in a vertical, gravity feeding position irrespective of the angular disposition of the common plane of the ball projecting wheels.

6 Claims, 3 Drawing Sheets

BALL THROWING DEVICE

BACKGROUND OF THE INVENTION

This invention relates to devices for throwing baseballs, tennis balls and the like, and more particularly to a simplified device for throwing a wide variety of types of baseball pitches.

Ball throwing devices have been utilized heretofore. For example, they have been used by tennis players to enable practice without the necessity of another player. They have also been used by baseball players for batting practice to avoid overworking the arms of pitchers.

The ball throwing device of this invention constitutes an improvement over the ball throwing device disclosed in U.S. Pat. No. 3,774,584 which has common assignee with the present invention. Although the earlier device is well suited for many applications, its limits of adjustability restrict its utility; its fixed infeed delivery chute renders ball feed somewhat cumbersome and inconvenient; and the unbalanced weight distribution of the adjustable assembly of the device render manipulation of the adjustable assembly somewhat difficult and imprecise.

SUMMARY OF THE INVENTION

The apparatus of this invention incorporates a base mounted ball throwing assembly balanced on a pivot carried on an angular arm which allows the ball projecting assembly to be adjusted infinitely to all positions between vertical and horizontal planes.

The principal objective of this invention is to provide a ball throwing device which overcomes the disadvantages and limitations of the aforementioned earlier U.S. Pat. No. 3,774,584.

Another object of this invention is the provision of a ball throwing device which allows the ball projecting mechanism to be adjusted to all positions between horizontal and vertical.

Still another object of this invention is the provision of a ball throwing device in which the ball throwing mechanism and control assembly is mounted at its center of gravity on a universal pivot, in a substantially balanced condition.

A further objective of this invention is the provision of a ball throwing device which includes a ball infeed that is adjustable to provide vertical gravity feed regardless of the angular disposition of the ball projecting assembly.

These and other objects and advantages of this invention will appear from the following detailed description, taken in connection with the accompanying drawings of a preferred embodiment.

DESCRIPTION OF THE PREFERRED EMBODIMENT

Figure 1:
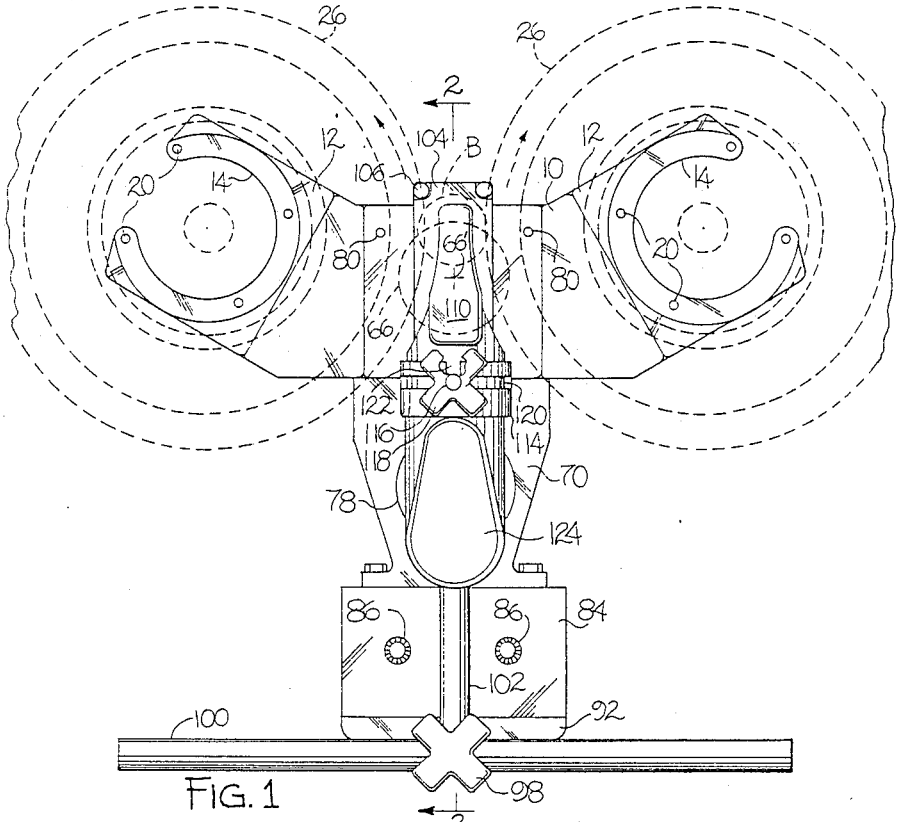
FIG. 1 is a fragmentary plan view of a ball throwing device embodying the features of this invention.

The ball throwing device of this invention includes a laterally elongated base member 10 provided with forwardly offset end portions 12 having openings 14 for receiving the output shafts 16 of electric motors 18 the housings of which are secured to the base member as by bolts in tapped bores 20. The output shafts of the electric motors mount hubs to which are secured by bolts 22 the wheels 24 which mount pneumatic or solid tires 26. The electric motors drive the wheels in opposite directions of rotation, as indicated by the arrows, and in a substantially common plane P which is parallel to the plane of the base member 10, 12.

The spacing between the confronting surfaces of the wheels is slightly less than the diameter of a ball B to be thrown. Accordingly, the ball is gripped between the rotating wheels and ejected forwardly therefrom, as explained more fully hereinafter.

The drive motors are preferably of the electric type illustrated. Further, the motors preferably are of the variable speed type in order to accommodate adjustment of the rotational speed of each wheel independently of the other.

Figure 3:
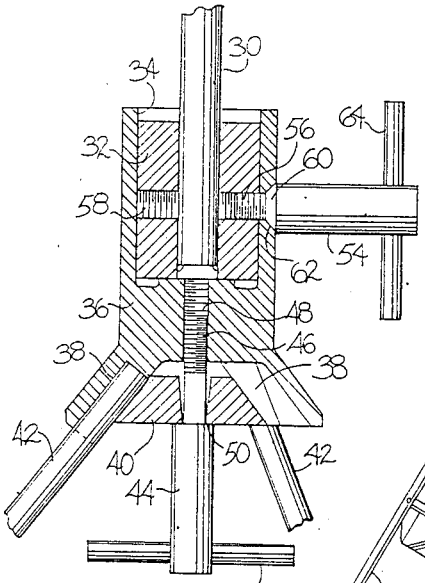
FIG. 3 is a fragmentary sectional view of the tripod leg coupler and base pivot assembly of the device shown in FIG. 1.

The base member 10, 12 is supported in a balanced condition, explained in detail hereinafter, by a universal pivot ball 28 mounted on the top end of an obliguely angularly bent support arm 30. The lower end of the support arm has an enlarged cylindrical pivot 32 (FIG. 3) welded or otherwise secured to it. The cylindrical pivot is contained rotatably in a bearing socket 34 provided at the top of a base support 36.

The lower end of the base support is flared outwardly and provided with three leg sockets 38 spaced 120° apart and diverging downwardly. The hollow center of the lower end of the base support receives a clamp member 40 of truncated conical shape, configured for clamping the upper ends of three support legs 42. This clamping is effected by a clamp screw 44 having a reduced diameter inner section 46 threaded for the reception in threaded bore 48 in the base support 36. A shoulder 50 at the juncture of the clamp screw body 44 and inner section 46 abuts the lower end of the clamp member 40 to move the latter upward toward the base support 36, whereby to clamp the legs securely but removably to the base support. The clamp screw 44 is turned by means of a T-handle 52.

The bent support arm 30 is secured in either of two positions 180° apart by means of a lock screw 54 (FIG. 3) having a reduced diameter threaded inner end 56 for releasably engaging one of two threaded bores 58 which extend in pivot 32 on a common diametrical line. A chamfered shoulder 60 between the lock screw body 54 and threaded inner end 56 cooperates with a tapered bore 62 in the base support 36 to ensure precise rotational positioning of the arm 30. A T-handle 64 on the lock screw facilitates turning.

The base member 10, 12 is provided with a socket 66 for the pivot ball 28. The socket has a diameter smaller than the pivot ball 28 and is provided about its circumference with an annular sleeve 68 of nylon or other material having a suitable low coeffecient of friction. This sleeve bears against the pivot ball a spaced distance above the center plane of the ball.

Figure 2:
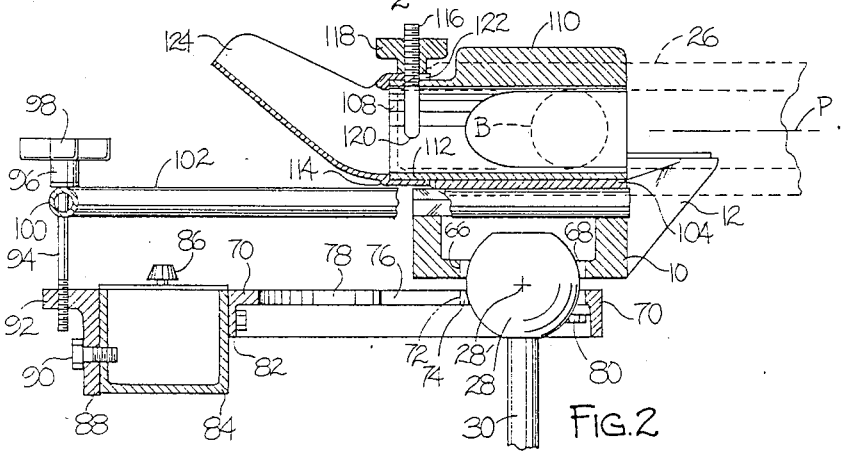
FIG. 2 is a fragmentary sectional view taken on the line 2—2 in FIG. 1.

A clamp member 70 (FIG. 2) also is provided adjacent its forward end with a socket 72 for the pivot ball 28. This socket also has a diameter smaller than the diameter of the pivot ball and is provided with an annular sleeve 74 similar to sleeve 68 for providing a low friction contact with the ball.

The socket 72 communicates through a rearwardly extending slot 76 with an entrance opening 78 which is larger in diameter than the ball 28. The opening 78 serves to receive the pivot ball 28 upwardly therethrough and the slot 76 serves to receive the support arm 30, for positioning the pivot ball in the socket 72, below the center of the ball.

The front end of the clamp member 70 is connected adjustably by bolts 80 to the forward, central portion of the base member 10. The rearward end of the clamp member 70 is provided with a downwardly extending flange 82 by which to mount the forward side of control box 84. This box contains the electrical control unit for varying the speeds of rotations of the tires 26. For this purpose the electrical control unit includes potentiometers having control knobs 86 disposed at the top of the control box.

The rear side of the control box supports the vertical section 88 of a clamp bar, as by screws 90. The horizontal section 92 of the clamp bar is provided with a threaded opening for receiving the reduced diameter threaded shank 94 of a clamp screw 96. The upper end of the clamp screw is provided with a hand knob 98 to facilitate its manipulation.

The threaded shank 94 extends freely through an opening at the juncture of the cross bar 100 of a T-handle the leg 102 of which extends forwardly for attachment to the base member 10. In the embodiment illustrated, this attachment is provided by a clamp plate 104 arranged to be releasably tightened against the leg 102 as by bolts 106.

By rotating the clamp screw 94 to move it into or out of the horizontal section 92, the rearward end of clamp member 70 and leg 102 are moved toward or away from each other, to clamp or release the base member 10 and clamp member 70 to or from the pivot ball 28. This allows readjustment of the rotational plane P of the ball projecting tires 26.

The clamp plate 104 also preferably mounts a ball feeder. This feeder includes a delivery section which is secured to the upper surface of the clamp plate and is provided with a rear tubular portion 108 the inner bore of which is slightly larger in diameter than a ball B. Extending forwardly of the tubular portion are elongated top and bottom fingers 110 and 112, respectively. These fingers extend forwardly between the tires 26 and have curved inner surfaces to confine a ball B against both horizontal and vertical displacement. By adjusting the bolts 106 to pivot the clamp plate 104 about the leg 102, the ball is delivered to the exact centerline between the tire treads where it is gripped frictionally and ejected forwardly therefrom.

The top finger 110 preferably is narrower in width than the spacing between the tires. This allows removal of one of the tires for repair or replacement, without the necessity of removing the ball feeder.

The ball feeder also includes a ball infeed section provided at its forward end with a tubular connector portion 114 configured to rotatably engage the rear tubular portion 108. The connector portion is secured releasably in rotational adjustment relative to the tubular portion 108 means of a clamp screw 116 secured to the tubular portion 108. A hand knob 118 is threaded to the clamp screw 116 and the latter is engagable in a 180° slot 120 in the connector portion 114. The clamp screw is accessible to the slot by means of an access slot 122 which communicates with the 180° slot from the forward end of the connector portion 114.

Extending angularly rearward from the connector portion 114 is a ball feed chute 124 which is open at its top side to receive a ball B for delivery to the space between the rotating tires 26. As explained more fully hereinafter, the ball feeder section is adjustable rotationally relative to the delivery section so that the ball feed chute 124 may remain pointing angularly upward for maximum effeciency of gravity feeding of balls, regardless of the angular disposition of the ball throwing wheels.

As mentioned hereinbefore, the base member 10, 12 is supported in a balanced condition by the universal pivot ball 28. It is more accurate to state that it is the base member and all of the components supported by it that is supported in balanced condition on the pivot ball. Thus, the assembly of base member, driven wheels 26, clamp member 70, T-handle 100, 102 and ball feeder has its balance point on the axis 66' (FIG. 1) of the socket 66 and its center of gravity at the center 28' (FIG. 2) of pivot ball 28. Accordingly, manipulation of the assembly by grasping the cross bar 100 of the T-handle is achieved with maximum precision and mimimum physical effort. In this regard, the earlier ball throwing device disclosed in U.S. Pat. No. 3,774,584 is significantly off-balance in the direction of the control handle, whereby care must be exercised in unclamping the assembly for readjustment to prevent the assembly from swinging sharply downward at the handle end, with consequent hazard to the operator and possible damage to the assembly.

Although the aforementioned earlier ball throwing device provides a substantial degree of adjustment of the rotational plane of the ball projecting wheels, the structural arrangement prevents adjustment of the rotational plane of the wheels infinitely to all positions between horizontal and vertical. This latter greater degree of adjustment is afforded by the provision in the present invention of the angled support arm 30.

Figures 8, 9, 10, 11, 12, 13, 14:
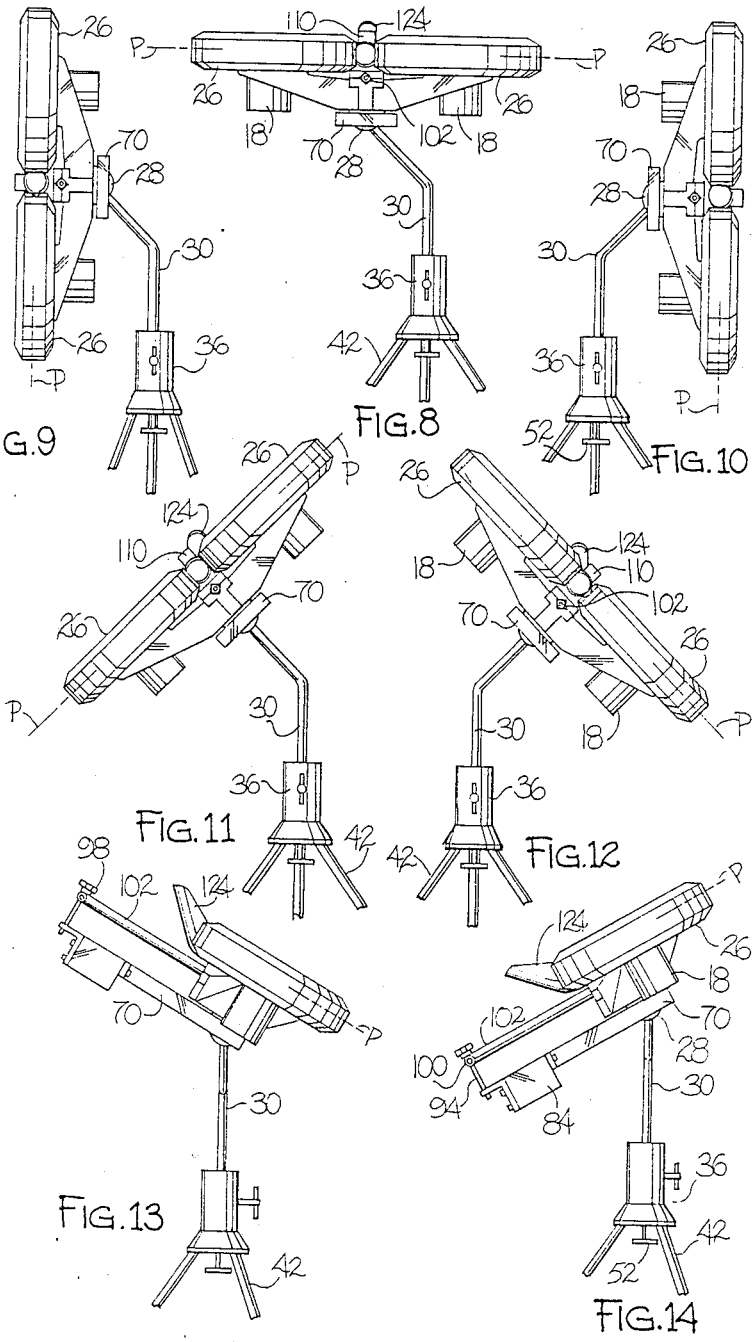

For example, FIG. 8 of the drawings shows the device adjusted to the position in which the rotational plane P of the wheels is horizontal and with the line of delivery of the ball B disposed to the left of the vertical axis of the base support 36. By rotating the support arm 30 through 180°, as afforded by removal of the lock screw 54, the ball projecting wheel assembly may be positioned with the ball projecting line disposed to the right of the vertical axis of the base support.

It is to be noted in FIG. 8 that the ball feed chute 124 is angled vertically upward for the optimum gravity feed of balls to the rotating wheels.

Figure 4:
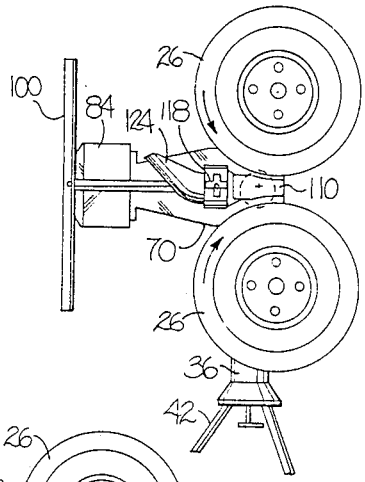
FIGS. 4–14 are fragmentary vertical elevational views of the device of FIG. 1 illustrating the range of adjustability of the ball projecting wheels accommodated by the structural components of the device.

FIGS. 9 and 10 show the ball projecting wheel assembly adjusted so its rotational plane P is disposed vertically for throwing a fast ball or a drop curve. FIG. 4 is a side elevation as viewed from the left in FIG. 9 and shows the ball infeed chute 124 rotated 90° from its position in FIG. 8, so as to incline vertically upward as in FIG. 8, again to provide optimum gravity feed of balls to the rotating wheels which now are disposed vertically.

FIGS. 11 and 12 show the ball projecting wheel assembly adjusted to an angular position intermediate the horizontal and vertical positions of FIGS. 8, 9 and 10. It is to be noted in these views that the ball infeed chute is adjusted to its optimum, vertically inclined position as previously described.

Figure 5:
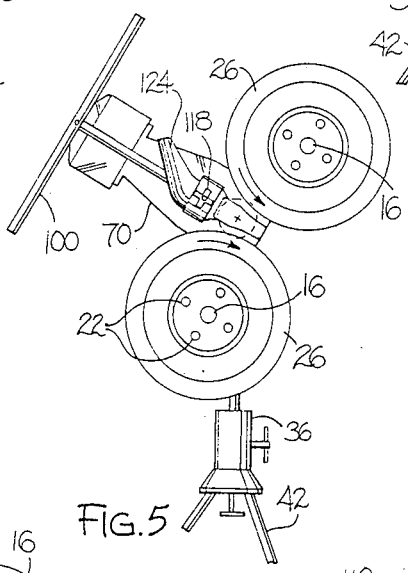

FIG. 13 shows the ball projecting wheel assembly titled forwardly downward, with the rotational plane P of the wheels disposed on a horizontal axis. This position may be utilized for throwing ground balls to the infield or outfield. The same practice may be achieved with different ball spin by the adjusted position illustrated in FIG. 5, wherein the rotational plane of the ball projecting wheels is vertical but the line of ball projection is tilted forwardly downward. In both adjustments, the ball infeed chute is adjusted to the optimum ball gravity feed position.

FIG. 14 illustrates the adjustment of the rotational plane P of the wheels on a horizontal axis but tilted forwardly upward as for throwing fly balls to the infield or outfield. The ball may be given side spin to curve it laterally. As in the previous illustrations, the ball infeed chute is angled vertically upward for optimum gravity feed of balls to the wheels.

Figure 6:
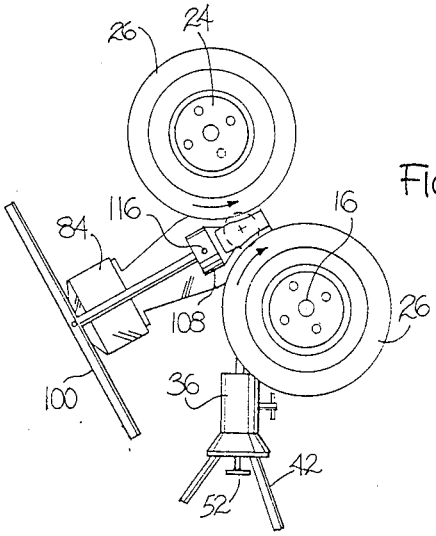

FIG. 6 illustrates the rotational plane of the ball projecting wheels disposed vertically but the line of projection of a ball inclined forwardly upward at an angle greater than that illustrated in FIG. 14. The ball may be given over spin or under spin, as desired. At this angle the ball infeed chute 124 is inoperative and hence the infeed section has been removed to facilitate hand feeding of balls to the delivery section of the feeder.

Figure 7:
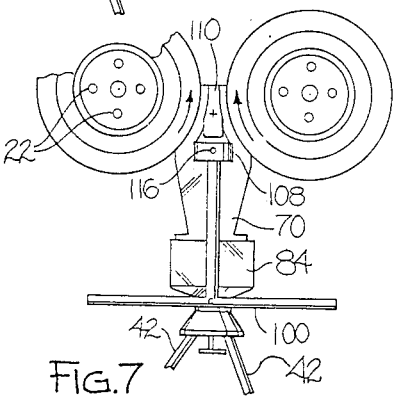

In FIG. 7 the rotational plane of the ball projecting wheels is once again disposed on a horizontal axis but adjusted to vertical for the throwing of practice pop-up balls. As in FIG. 6, the feed chute has been removed to facilitate the hand feeding of balls vertically upward into the delivery section.

As in the earlier ball throwing device of U.S. Pat. No. 3,774,584 the foregoing angular adjustments of the rotational plane P of the ball projecting wheels, together with adjustments in relative rotational speeds of the wheels, provides a wide range of types, directions and speeds of throws and pitches. For example, referring to FIG. 11, the rotational plane of the wheels is shown inclined upwardly toward the right as viewed, for example, by a batter during batting practice. By rotating the upper wheel faster than the lower wheel a baseball pitched from between the wheels takes the same curved trajectory as a left handed overhand curve thrown by a pitcher. When the plane of rotation of the wheels is adjusted to the position shown in FIG. 12, and the upper wheel rotated faster than the lower wheel, the pitched ball takes the same trajectory as a right handed overhand curve delivered by a pitcher.

With the rotational plane of the wheels disposed as in FIGS. 11 and 12 and both wheels rotating at the same speed, the degree of curvature of the pitch is reduced both horizontally and vertically. By rotating the lower wheel faster than the upper wheel, the trajectory of the pitch is both horizontal and upward.

When the plane of rotation of the wheels is adjusted to horizontal, as in FIG. 8, and one of the wheels is rotated faster than the other, the curve has a lesser degree of vertical component. With the rotational plane of the wheels disposed horizontally and with one of the wheels rotating only slightly faster than the other, a substantially straight fast ball will be delivered to the batter. The speed of the pitch may be varied by increasing or decreasing the rotational speed of the wheel, as will be understood. When both wheels are rotated at exactly the same speed, the pitch is a knuckler.

The provision of the bent support arm 30 rotatable to opposite, 180° positions by the diametrically opposite threaded bores 58 and lock screw 54, allows the device to throw any type of pitch with maximum stability by keeping one leg 42 facing the operator and the other two legs facing forward toward the batter. This arrangement best absorbs the recoil that takes place when a ball is thrown, thereby inhibiting the device from moving around on the ground from its preset position. This results in the device throwing more accurate and reproducible pitches over the course of many throws, without the need to reposition the device.

As in the earlier patent, the simplified construction described hereinbefore affords transport of the device to and from an operating site but with greater stability and ease than the earlier construction. In this regard, the device may be tipped to one side, such as in FIG. 9, with the tires 26 resting on the ground and the handle 100, 102 extending upward. In this position the device may be grasped by the rearwardly inclined leg 42 and rolled from a site of operation to an automobile. Because of the angled support arm 30, this maneuver is accomplished with greater ease and stability than is afforded by the construction of the earlier patent by positioning the operator behind and in line with the wheels. Then, by simply loosening the single clamp screw 44 to loosen the clamp member 40, the legs 42 may be removed from the base support 36. The remaining assembly is of sufficiently light weight that it may be lifted by one person and deposited in the trunk of the automobile, together with the legs.

From the foregoing it will be appreciated that the present invention provide a ball throwing device which overcomes certain limitations and affords other advantages over the ball throwing device disclosed in the aforementioned U.S. Pat. No. 3,774,584. Principal among these is the provision of the balanced assembly mounted on the universal pivot ball 28; the angularly bent support arm 30 which allows adjustment of the plane P of rotation of the ball projecting wheels infinitely to all positions between horizontal and vertical; and the rotationally adjustable ball infeed chute 124 which allows adjustment of the chute to a vertical plane for optimum delivery of balls by gravity to the ball projecting wheels, regardless of the angular disposition of the wheels.

It will be apparent to those skilled in the art that various changes may be made in the size, shape, type, number and arrangement of parts described hereinbefore. For example, although the illustrated embodiment of the invention utilizes two rotating tires for projecting a ball from between them, other forms of ball projecting mechanisms may be utilized. For example, the arrangement of a single fixed pad in association with one rotary wheel as disclosed in commonly owned U.S. Pat. No. 4,080,950 may be substituted for the two rotary wheels illustrated. The spacing between the ball projecting components, such as the tires 26 illustrated, may be changed to accommodate the throwing of tennis balls, soft balls, and the like, it being understood that the dimensions of the ball feeder delivery and infeed sections will also be changed accordingly. These and other changes may be made, as desired, without departing from the spirit of this invention and the scope of the appended claims.

Having now described our invention and the manner in which it may be used, we claim:

1. A ball throwing device, comprising:

(a) a base member, (b) ball projecting means mounted on the base member and operable to project a ball therefrom in a plane thereof, (c) a base support having a central vertical axis (d) an elongated, one-piece, rigid support arm mounted at its bottom end on the base support, said support arm having an oblique angular bend intermediate its ends and having a portion thereof extending along said vertical axis of said base support, (e) a universal mounting ball on the upper end of the support arm, (f) a ball-receiving socket on the base member, and (g) clamp means on the base member releasably engaging the mounting ball for releasably securing the base member to the mounting ball for adjusting the plane of the ball projecting means between a substantially horizontal position above the mounting ball and a substantially vertical position to the side of the support arm.

2. The ball throwing device of claim 1 wherein the base support and support arm are interconnected for rotation of the support arm relative to the base support, and lock means releasably interengages the base support and support arm for securing the support arm to the base support in selected positions of relative rotation, the lock means including a lock screw releasably engagable in diametrically opposite threaded bores adjacent the bottom end of the support arm.

3. The ball throwing device of claim 1 wherein the base support includes a socket configured to mount the bottom end of the support arm for axial rotation therein, and lock means releasably interengages the base support and support arm for securing the support arm to the base support in selected positions of relative rotation, the lock means including a lock screw releasably engagable in diametrically opposite threaded bores adjacent the bottom end of the support arm.

4. The ball throwing device of claim 1 wherein the ball-receiving socket is positioned on the base member at substantially the center of gravity of the assembly of base member and components supported thereon.

5. The ball throwing device of claim 1 wherein the ball projecting means comprises a pair of drive motors mounted on the base member and each having a rotary output shaft, and a pair of wheels mounted one on each of said output shafts and arranged in spaced relation for rotation in a substantially common plane, the spacing between the wheels being less than the diameter of a ball to be thrown, and the ball throwing device includes:

(a) a ball delivery section mounted on the base member and extending between the ball projecting means for delivering a ball therebetween along the longitudinal axis of the delivery section, (b) a ball infeed section having a connecting portion mounted on the ball delivery section for rotational adjustment about the longitudinal axis of the delivery section, and a ball feed chute portion extending angularly rearward from the connecting portion, (c) the ball infeed section being adjustable rotationally relative to the delivery section for maintaining the feed chute portion in a vertical plane for gravity feeding of a ball to the delivery section irrespective of the angular disposition of the base member.

(d) a clamp screw on the ball delivery section, and (e) a circumferential slot in the connecting portion of the ball infeed section configured to receive said clamp screw for securing the feed chute portion in desired rotational position, the circumferential slot extending at least 180° around said connecting portion.

6. A ball throwing device, comprising:

(a) a base member, (b) a pair of drive motors mounted on the base member and each having a rotary output shaft, (c) a pair of wheels mounted one on each of said output shafts and arranged in spaced relation for rotation in a substantially common plane, the spacing between the wheels being less than the diameter of a ball to be thrown, (d) a base support, (e) an elongated, one-piece, rigid support arm rotatably at its bottom end and extending obliquely upward therefrom, (f) lock means releasably interengaging the base support and support arm for securing the support arm to the base support in selected positions of relative rotation, the lock means including a lock screw releasably engageable in diametrically opposite threaded bores adjacent the bottom end of the support arm, (g) a universal mounting ball on the upper end of the support arm, (h) a ball-receiving socket on the base member positioned on the base member at substantially the center of gravity of the assembly of base member and components supported thereon, (i) clamp means on the base member releasably engaging the mounting ball for releasably securing the base member to the mounting ball for adjusting the plane of the ball projecting means between a substantially horizontal position above the mounting ball and a substantially vertical position to the side of the support arm, (j) a ball delivery section mounted on the base member and extending between the ball projecting wheels for delivering a ball therebetween along the longitudinal axis of the delivery section, (k) a ball infeed section having a connecting portion mounted on the ball delivery section for rotational adjustment about the longitudinal axis of the delivery section, and a ball feed chute portion extending angularly rearward from the connecting portion, (l) the ball infeed section being adjustable rotational relative to the delivery section for maintaining the ball chute portion in a vertical plane for gravity feeding of a ball to the delivery section irrespective of the angular disposition of the base member, (m) a clamp screw on the ball delivery section, (n) a circumferential slot in the connecting portion of the ball infeed section configured to receive said clamp screw for securing the feed chute portion in desired rotational position, the circumferential slot extending at least 180° around said connecting portion, and (o) a clamp screw access slot in the connecting portion of the ball infeed section communicating with the circumferential slot for removably installing the ball infeed section on the ball delivery section without removing the clamp screw.

* * * * *